US006394763B1

(12) United States Patent
Harte et al.

(10) Patent No.: US 6,394,763 B1
(45) Date of Patent: May 28, 2002

(54) LUBRICATION FINS AND BLADES FOR A SWASH PLATE TYPE COMPRESSOR

(75) Inventors: Shane A. Harte, Farmington Hills; Guntis V. Strikis, Belleville; Lavlesh Sud, Farmington Hills, all of MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/750,390

(22) Filed: Dec. 28, 2000

(51) Int. Cl.[7] ..... F04B 1/12; F04B 27/08; F01M 9/00; F01B 3/00; F01B 31/00

(52) U.S. Cl. ..... 417/269; 417/222.1; 184/6.17; 92/71; 92/154

(58) Field of Search ..... 417/269, 222.1, 417/222.2; 184/6.17, 11.1; 92/71, 153, 154

(56) References Cited

U.S. PATENT DOCUMENTS 1,345,808 A * 7/1920 Reynolds ..... 123/193.4
2,400,119 A * 5/1946 Joy ..... 417/203
2,491,747 A 12/1949 Maier ..... 184/6
4,005,948 A 2/1977 Hiraga et al. ..... 417/269
4,236,878 A * 12/1980 Terauchi ..... 417/269
4,260,337 A * 4/1981 Nomura ..... 417/269
4,301,716 A * 11/1981 Saegusa et al. ..... 417/269
4,444,549 A 4/1984 Takahashi et al. ..... 417/269
5,131,319 A * 7/1992 Ono et al. ..... 184/6.17
5,370,505 A 12/1994 Takenaka et al. ..... 417/269
5,495,789 A * 3/1996 Ogura et al. ..... 92/154
5,782,316 A * 7/1998 Kobayashi et al. ..... 184/6.17

* cited by examiner

*Primary Examiner*—Charles G. Freay
*Assistant Examiner*—Timothy P. Solak
(74) *Attorney, Agent, or Firm*—Larry I. Shelton

(57) ABSTRACT

A variable displacement swash plate type compressor which incorporates an impeller attached to a drive shaft, and a plurality of blades for, efficiently directing lubricating oil to a shaft seal. The impeller provides a mist of lubricating oil to the crankcase, and the blades direct lubricating oil to a shaft seal. The impeller and blades maximize the distribution and flow of lubricating oil to the crank chamber under all operating conditions providing cooling and lubrication to the internal moving components within the crankcase.

12 Claims, 4 Drawing Sheets

LUBRICATION FINS AND BLADES FOR A SWASH PLATE TYPE COMPRESSOR

FIELD OF THE INVENTION

The present invention relates to a variable displacement swash plate type compressor adapted for use in an air conditioning system for a vehicle, and more particularly to a compressor having an impeller attached to a drive shaft providing a mist of lubricating oil to the crank chamber, and a plurality of stationary blades formed in a crank chamber for efficiently directing lubricating oil to a shaft seal.

BACKGROUND OF THE INVENTION

A typical conventional variable displacement swash plate type compressor includes a cylinder block provided with a number of cylinders, a piston disposed in each of the cylinders of the cylinder block, a crankcase sealingly disposed on one end of the cylinder block, a cylinder head sealingly disposed on the other end of the cylinder block, a rotatably supported drive shaft, and a swash plate. The swash plate is adapted to be rotated by the drive shaft. Rotation of the swash plate is effective to reciprocatively drive the pistons. The length of the stroke of the pistons is varied by the inclination of the swash plate. Inclination of the swash plate is varied by controlling the pressure differential between a suction chamber and a crank chamber. Lubrication of components within the crankcase is typically provided by circulating refrigerant gas mixed with lubricating oil within the internal refrigerant circuit of the compressor. Typical conventional variable displacement swash plate type compressors may also use carbon dioxide as the refrigerant gas.

Another conventional lubricating system disclosed in the prior art employs lubricating oil passageways separately arranged from the refrigeration circuits. The separately arranged oil passageways avoid reduction in the refrigerating efficiency of a refrigeration circuit in a vehicle caused by an attachment of the lubricating oil to an evaporator of an air conditioning system. For example, lubricating oil maybe pumped by a gear pump through a lubrication passage and radial branch passageways within the drive shaft to lubricate the moving components within the crank chamber.

The compressor arrangements in the prior art in which carbon dioxide is used as the refrigerant gas have several disadvantages. First, due to the fact that conventional lubricating oil is not soluble in carbon dioxide, the lubricating oil cannot be effectively distributed with the carbon dioxide as it is circulated within the internal refrigeration circuit, resulting in ineffective lubrication of the close tolerance moving parts within the crank chamber. Second, in a compressor having separately arranged lubrication passages, the lubricating oil is subjected to a gradual pressure drop while flowing inside the lubrication passages. The volume of the oil flowing out of the branch passageways furthest from the gear pump is caused to become less than the volume of oil flowing out of the branch passageways nearest the gear pump. In such an arrangement lubricating oil is not efficiently and effectively distributed within the crank chamber.

An object of the present invention is to produce a swash plate type compressor wherein oil flow to the crankcase during both minimum and maximum operating conditions is improved to result in efficient lubrication of the compressor components.

Another object of the present invention is to produce a swash plate type compressor wherein lubricating oil can be efficiently and evenly distributed within the crank chamber.

SUMMARY OF THE INVENTION

The above, as well as other objects of the invention, may be readily achieved by a variable displacement swash plate type compressor including a housing; a drive shaft rotatably supported in the housing, the housing including a plurality of radially arrayed blades to direct oil to a shaft seal; and a pump for distributing the lubricating oil from an oil sump facilitating distribution of lubricating oil to the compressor, the pump including an annular array of fins rotated by the drive shaft to either agitate the oil in the sump to produce a mist in the crankcase or direct the oil by centrifugal force from the sump through the compressor.

BRIEF DESCRIPTION OF THE DRAWINGS

The above, as well as other objects, features, and advantages of the present invention will be understood from the following detailed description of the preferred embodiment of the present invention with reference to the accompanying drawings, in which.

DETAILED DESCRIPTION OF THE PREFERRED EMBODIMENT

Figure 1:
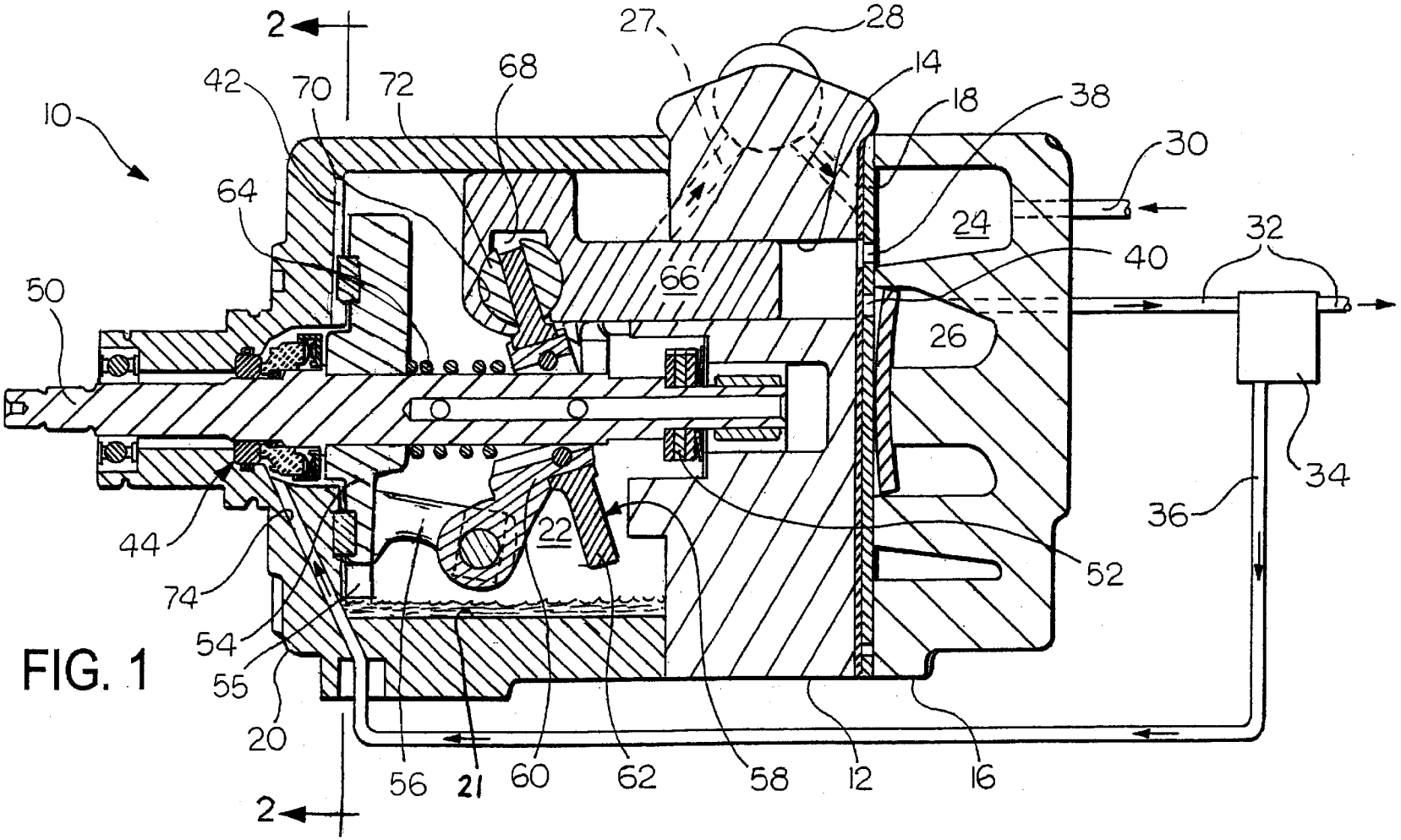
FIG. 1 is a cross sectional elevational view of a variable displacement swash plate type compressor incorporating the features of the invention showing an impeller having an annular array of fins formed thereon and blades formed adjacent thereto.

Referring to the drawings, and particularly FIG. 1, there is shown generally at 10 a variable displacement swash plate type compressor incorporating the features of the invention. The compressor 10 includes a cylinder block 12 having a plurality of cylinders 14. A cylinder head 16 is disposed adjacent one end of the cylinder block 12 and sealingly closes the end of the cylinder block 12. A valve plate 18 is disposed between the cylinder block 12 and the cylinder head 16. A crankcase 20 includes a first end, a second end, an upper portion, and a lower portion. The second end of the crank case 20 is sealingly disposed at the other end of the cylinder block 12 and includes an oil sump 21 formed therein. The second end of the crankcase 20 and cylinder block 12 cooperate to form an airtight crank chamber 22.

The cylinder head 16 includes a suction chamber 24 and a discharge chamber 26. A conduit 27 is disposed to provide fluid communication between the crank chamber 22 and the suction chamber 24. An electronic control valve 28 is disposed in the conduit 27 for controlling the flow of refrigerant gas from the crank chamber 22 to the suction chamber 24. The valve 28 can be of any conventional type such as, for example, a ball type valve. The valve 28 is designed to receive an electrical control signal from a remote microprocessor (not shown). The microprocessor monitors the discharge pressure of the compressor, the RPM of the vehicle engine, the cabin temperature and humidity, and the like, to control the valve 28 which, in turn, controls the flow of refrigerant gas from the crank chamber 22 to the suction chamber 24. An inlet port 30 provides fluid communication between an evaporator (not shown) of the cooling portion of an air conditioning system for a vehicle and the suction chamber 24. An outlet conduit 32 provides fluid communication between the discharge chamber 26 and the cooling portion of the air conditioning system for a vehicle. An oil separator 34 is disposed in the conduit 32. An orifice tube 36 provides fluid communication between the oil separator 34 and the crank chamber 22.

Suction ports 38 provide fluid communication between the suction chamber 24 and each cylinder 14. Discharge ports 40 provide fluid communication between each cylinder 14 and the discharge chamber 26.

Figure 2:
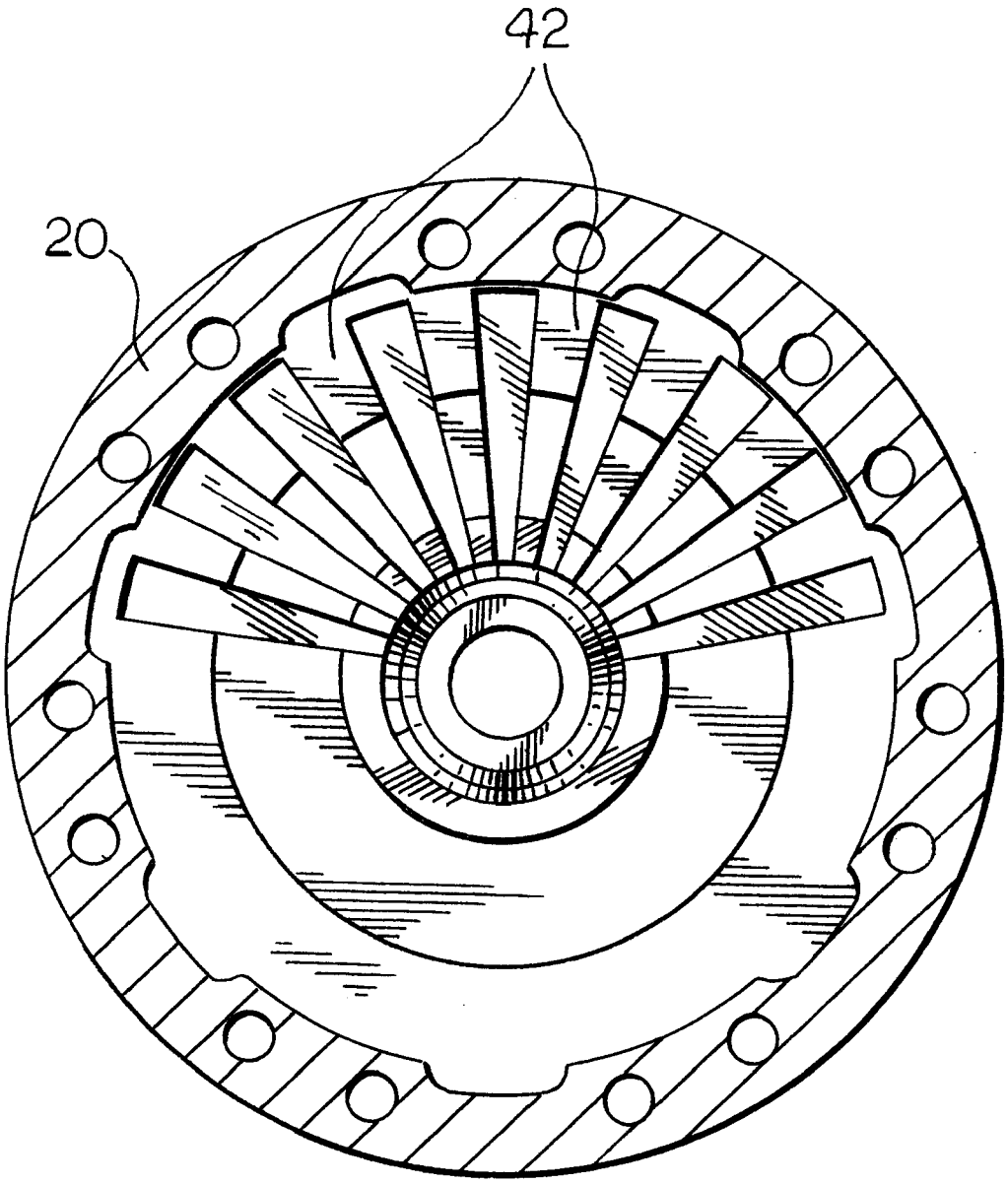
FIG. 2 is a cross sectional elevational view of the compressor illustrated in FIG. 1 taken along line 2—2 showing the stationary blades formed therein.
Figure 3:
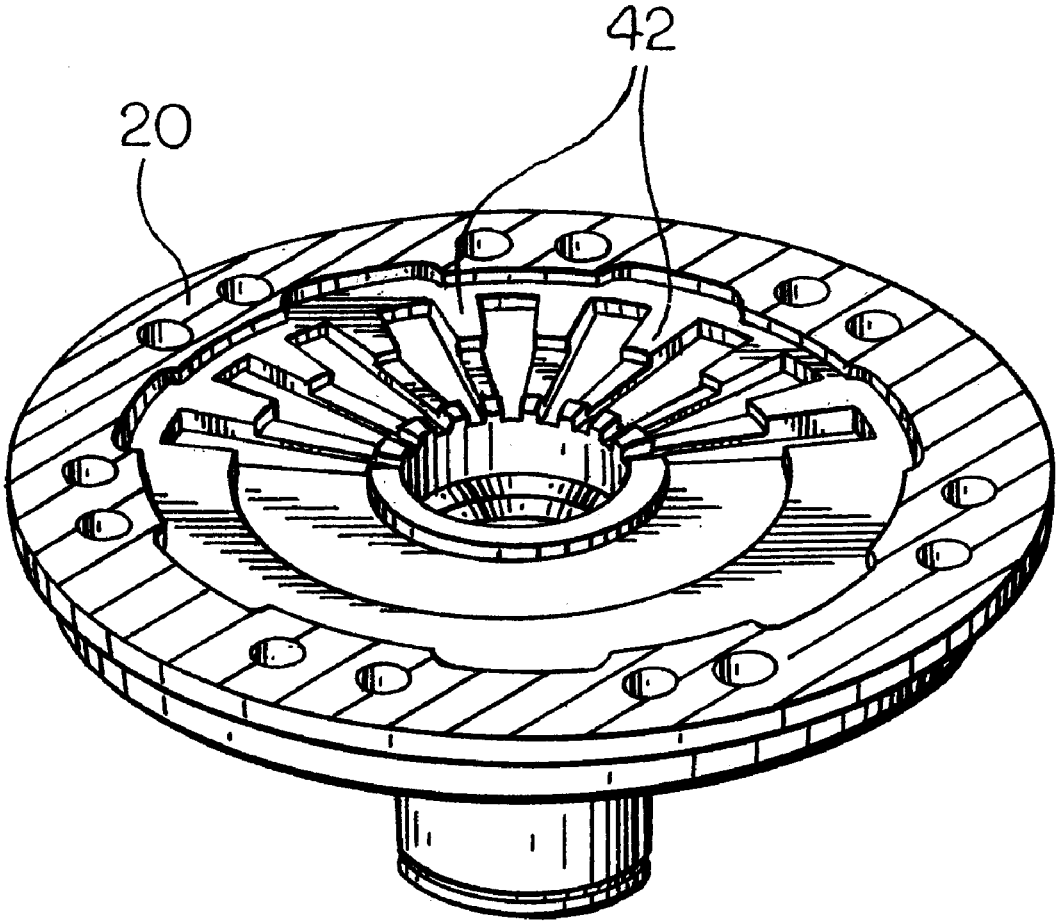
FIG. 3 is a perspective view of the stationary blades illustrated in FIG. 2.

The crankcase 20 includes a plurality of radially arranged blades 42, as illustrated in detail in FIGS. 2 and 3, formed in an inner surface of the upper portion of the first end thereof for directing oil radially inward toward a shaft seal 44. A drive shaft 50 is centrally disposed in and arranged to extend through the crankcase 20 to the cylinder block 12. One end of the drive shaft 50 is rotatably supported by a suitable bearing mounted in the crankcase 20, and the other end of the drive shaft 50 is rotatably supported in a suitable bearing mounted in the cylinder block 12. Longitudinal movement of the drive shaft 50 is restricted by a thrust bearing 52 mounted in the cylinder block 12.

Figure 4:
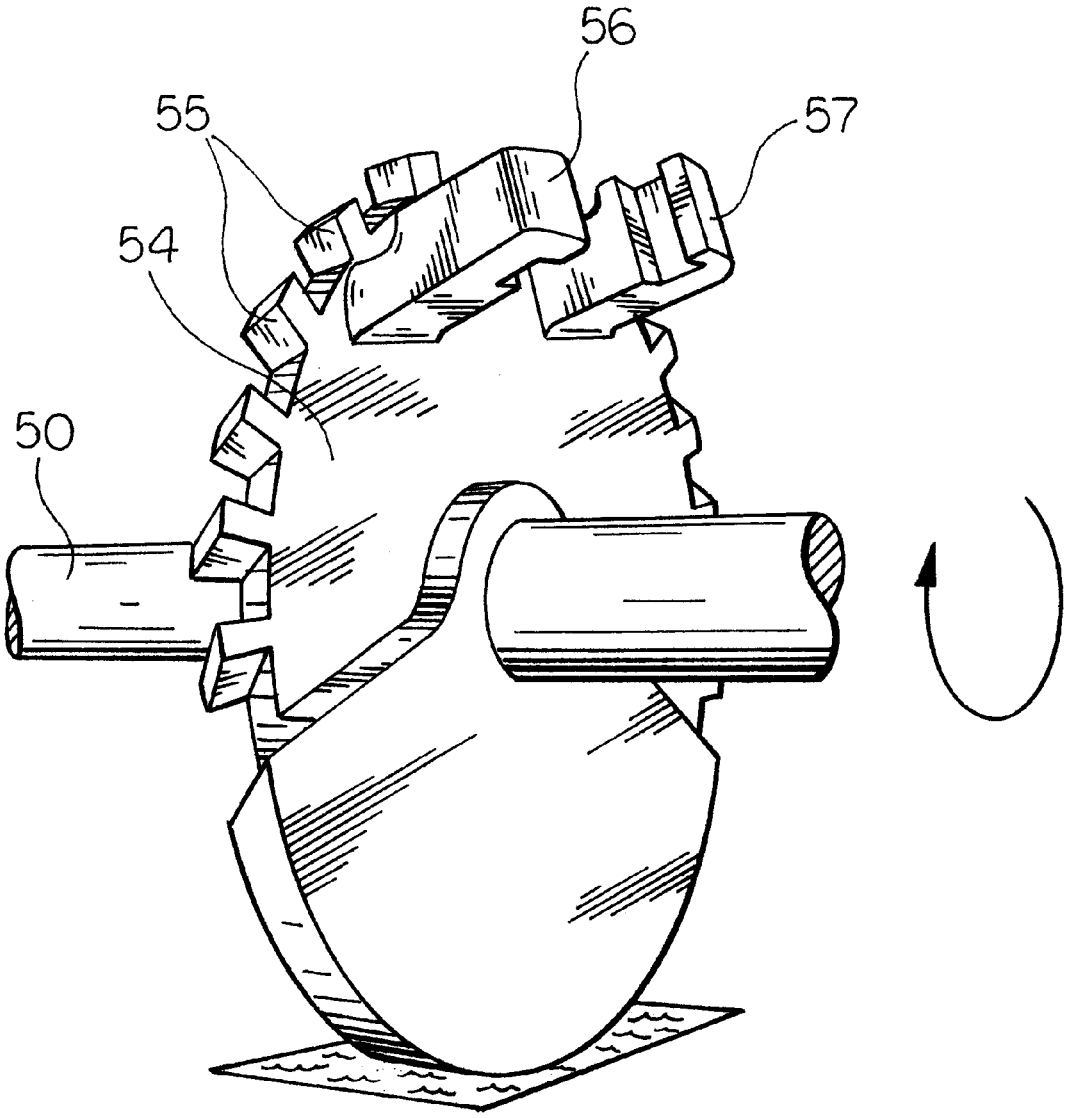
FIG. 4 is an enlarged perspective view of the impeller illustrated in FIG. 1 showing the fins formed from the periphery thereof.

An impeller 54 is fixedly mounted on the drive shaft 50 adjacent one end of the crankcase 20 within the crank chamber 22. The impeller 54 includes a plurality of radially outwardly extending fins 55 formed along the peripheral edge thereof, as illustrated in FIG. 4. Arms 56, 57 extend outwardly from a surface of the impeller 54 opposite the surface of the impeller 54 that is adjacent the end of the crankcase 20.

A swash plate 58 is formed to include a hub 60 and an annular plate 62. The arms 56, 57 of the impeller 54 are hingedly connected to the hub 60.

The hub 60 is press fit in a suitable central aperture of the annular plate 62. In the assembled form, the drive shaft 50 is adapted to extend through the central aperture of the hub 60.

A helical compression spring 64 is disposed to extend around the outer surface of the drive shaft 50. One end of the spring 64 abuts the impeller 54, while the opposite end abuts the hub 60 of the swash plate 58. The spring 64 tends to urge the swash plate 58 away from the impeller 54.

A piston 66 is slidably disposed in each of the cylinders 14 in the cylinder block 12. Each piston 66 includes an interior space 68 for receiving the annular plate 62. Spaced apart concave pockets 70 are formed in the interior space 68 of the piston 66 for rotatably containing a pair of semi-spherical shoes 72. The spherical surfaces of the shoes 72 are disposed in the shoe pockets 70 with a flat bearing surface disposed opposite the spherical surface for slidable engagement with the opposing sides of the annular plate 62.

In operation, the compressor 10 is actuated by the rotation of the drive shaft 50 which is typically an associated internal combustion engine of a vehicle. Rotation of the drive shaft 50 causes the simultaneous rotation of the impeller 54. The hub 60 of the swash plate 58 is hingedly connected to the arm 56 of the impeller 54. Rotation of the impeller 54 causes the swash plate 58 to rotate. During rotation, the swash plate 58 is disposed at an inclination. The rotation of the swash plate 58 is effective to reciprocatively drive the pistons 66. The rotation of the swash plate 58 further causes a sliding engagement between the annular plate 62 and the cooperating spaced apart shoes 72.

The reciprocation of the pistons 66 causes refrigerant gas to be introduced from the suction chamber 24 into the respective cylinders 14 of the cylinder head 16. The reciprocating motion of the pistons 66 then compresses the refrigerant gas within each cylinder 14. When the pressure within each cylinder 14 reaches the pressure within the discharge chamber 26, the compressed refrigerant gas is discharged into the discharge chamber 26.

The capacity of the compressor 10 can be changed by changing the inclination of the swash plate 58 and thereby changing the length of the stroke for the pistons 66.

The valve 28 is arranged to monitor the suction and crank chamber pressures of the compressor 10, and control the flow of refrigerant gas from the crank chamber 22 to the suction chamber 24. When an increase in thermal load occurs, the valve 28 is caused to open, thereby causing refrigerant gas to flow through the valve 28 to the suction chamber 24. The pressure differential between the crank chamber 22 and the suction chamber 24 is then equalized. As a result of the decreased backpressure acting on the pistons 66 in the crank chamber 22, the swash plate 58 is moved against the force of the spring 64, the inclination of the swash plate 58 is increased, and as a result, the length of the stroke of each piston 66 is increased.

Conversely, when a decrease in thermal load occurs, the valve 28 is caused to close, thereby reducing the flow of refrigerant gas from the crank chamber 22 to the suction chamber 24. Because the flow of pressurized refrigerant gas to the crank chamber 22 from the discharge 26 is larger than the flow of refrigerant gas from the crank chamber 22 to the suction chamber 24, the backpressure acting on the pistons 66 in the crank chamber 22 is increased. As a result of the increased backpressure in the crank chamber 22, the swash plate 58 yields to the force of the spring 64, the inclination of the swash plate 58 is decreased, and as a result, the length of the stroke of each piston 66 is reduced.

Lubricating oil is introduced into the orifice tube 36 from the oil separator 34, and caused to flow through a passage 74 to suitable relatively moving bearing surfaces of the shaft seal 44 and into the crank chamber 22. Gravitational forces then cause the oil to be collected in the sump 21.

The relatively moving bearing surfaces of the shaft seal 44 frictionally engage one another as the drive shaft 50 rotates, and therefore require lubricant to reduce the coefficient of friction and cooperate to effect an acceptable duty cycle.

In the preferred embodiment, the fins 55 of the impeller 54 are formed in such a manner as to contact and agitate the oil in the sump 21 as the impeller 54 rotates, thereby causing a mist of oil to be distributed within the crank chamber 22. Any oil adhered to the fins 55 will be directed by centrifugal force outwardly of the impeller 54 to the moving components within the crank chamber 22. The fins 55 are arranged at a suitable angle such that a portion of the oil directed by centrifugal force will be caused to contact the blades 42. The blades 42 are operative to direct oil received from the fins 55 to the shaft seal 44.

By introducing lubricating oil from the oil sump 21 into the crank chamber 22 with the fins 55, the lubricating efficiency of the compressor 10 is maximized. By introducing lubricating oil to the bearing surfaces of the shaft seal 44, the lubrication of the shaft seal 44 is also maximized. The lubricating oil is caused to be distributed from the oil sump 21 to the crank chamber 22 by the fins 55 during both minimum and maximum operating conditions of the compressor 10. Further, the blades 42 cause lubricating oil to be delivered to the shaft seal 44 during both minimum and maximum operating conditions of the compressor 10, and at times when lubricating oil may be caused to ineffectively flow to the shaft seal 44. The use of the fins 55 and blades 42 facilitate efficient distribution of lubricating oil into the crank chamber 22 and to the shaft seal 44. The lubricating oil introduced into the crank chamber 22 by the fins 55 provides lubrication to the close tolerance moving components within the crank chamber 22 such as the bearings, the swash plate 58, the shoe pockets 70, and the shoes 72. The introduction of lubricating oil to the crank chamber 22 and shaft seal 44 thereby improves the durability of the compressor 10.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. Lubrication means for a variable displacement swash plate type compressor, the compressor having a cylinder head, a cylinder block, a crankcase forming a crank chamber therein, an oil sump, a drive shaft, a shaft seal disposed between the drive shaft and the crankcase, and a plurality of pistons, comprising:

an impeller attached to the drive shaft and hingedly engaged with a swash plate, said impeller including an annular array of fins formed on the outer periphery thereof for agitating the lubricating oil from the oil sump to produce a mist of lubricating oil within the crankcase.

2. The compressor according to claim 1, wherein said impeller comprises a rotor.

3. The compressor according to claim 1, wherein said blades are formed on an inner surface of the crankcase.

4. The compressor according to claim 3, wherein said blades are radially arranged to direct lubricating oil to the shaft seal.

5. The compressor according to claim 1, including a plurality of blades disposed in said crankcase, said blades directing lubricating oil to the shaft seal disposed between the drive shaft and the crankcase.

6. A variable displacement swash plate type compressor comprising:

a cylinder block having a plurality of cylinders arranged radially therein;

an oil sump for containing lubricating oil;

a piston reciprocatively disposed in each of the cylinders of said cylinder block;

a cylinder head attached to said cylinder block;

a crankcase attached to said cylinder block to define a crank chamber;

a drive shaft rotatably supported by said crankcase and said cylinder block;

a swash plate adapted to be driven by said drive shaft, said swash plate having a central aperture for receiving said drive shaft; and an impeller attached to said drive shaft and hingedly engaged with said swash plate, said impeller including an annular array of fins formed on the outer periphery thereof for agitating the lubricating oil from said oil sump to produce a mist of lubricating oil within said crankcase.

7. The compressor according to claim 6, including a plurality of blades disposed in said crankcase, said blades directing lubricating oil to a shaft seal disposed between said drive shaft and said crankcase.

8. The compressor according to claim 7, wherein said blades are formed on an inner surface of said crankcase.

9. The compressor according to claim 8, wherein said blades are radially arranged to direct lubricating oil to said shaft seal.

10. The compressor according to claim 6, wherein said oil sump is formed in said crankcase.

11. The compressor according to claim 10, wherein said impeller comprises a rotor.

12. A variable displacement swash plate type compressor comprising:

a cylinder block having a plurality of cylinders arranged radially therein;

an oil sump for containing lubricating oil formed within said crankcase;

a piston reciprocatively disposed in each of the cylinders of said cylinder block;

a cylinder head attached to said cylinder block and having a suction chamber and a discharge chamber formed therein;

a crankcase attached to said cylinder block and cooperating with said cylinder block to define a crank chamber;

a drive shaft rotatably supported by said crankcase and said cylinder block and adapted to be coupled to an auxiliary drive means;

a shaft seal disposed between said drive shaft and said crankcase;

an impeller fixedly mounted on said drive shaft, said impeller including an annular array of fins formed on the outer periphery thereof;

a swash plate adapted to be driven by said drive shaft and having a central aperture for receiving said drive shaft;

hinge means disposed between said impeller and said swash plate to hingedly connect said impeller and said swash plate; and a plurality of blades formed in an inner surface of said crankcase, said blades directing lubricating oil to said shaft seal.

* * * * *